US005206134A

United States Patent [19]

Yamada et al.

[11] Patent Number: 5,206,134

[45] Date of Patent: Apr. 27, 1993

[54] METHOD FOR PRODUCING SILVER HALIDE PHOTOGRAPHIC EMULSION

[75] Inventors: Sumito Yamada; Tetsuo Nakamura, both of Kanagawa, Japan

[73] Assignee: Fuji Photo Film Co., Ltd., Kanagawa, Japan

[21] Appl. No.: 750,684

[22] Filed: Aug. 27, 1991

[30] Foreign Application Priority Data

Aug. 28, 1990 [JP] Japan ..... 2-225637

[51] Int. Cl.[5] ..... G03C 1/005; G03C 1/035

[52] U.S. Cl. ..... 430/569; 430/567

[58] Field of Search ..... 430/569, 621, 963, 567

[56] References Cited

U.S. PATENT DOCUMENTS

| | | | |
|---|---|---|---|
| 4,798,775 | 1/1989 | Yagi et al. | 430/569 |
| 4,826,757 | 5/1989 | Yamada et al. | 430/621 |
| 4,861,702 | 8/1989 | Suzuki et al. | 430/963 |
| 4,962,015 | 10/1990 | Aida et al. | 430/569 |
| 5,112,731 | 5/1992 | Miyasaka | 430/963 |

FOREIGN PATENT DOCUMENTS

| | | |
|---|---|---|
| 0165576 | 12/1985 | European Pat. Off. . |
| 0308193 | 3/1989 | European Pat. Off. . |
| 0370116 | 5/1990 | European Pat. Off. . |

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A method for producing a silver halide photographic emulsion comprising silver iodobromide or iodobromochloride grains having an average iodine content of less than 1.0 mol %, which comprises the following step (a) or (b) to form a surface portion of the grains such that the step provides the surface portion having an iodine content of 0.005 mol % to less than 0.3 mol % based on the total amount of silver in the grains:

(a) adding simultaneously a silver nitrate solution and a solution which contains iodine ion; or (b) adding fine particles of AgI and/or fine particles of AgBrI.

The emulsion thus produced is suitable for photosensitive materials which are subjected to ultra-rapid automatic development processing.

16 Claims, No Drawings

METHOD FOR PRODUCING SILVER HALIDE PHOTOGRAPHIC EMULSION

FIELD OF THE INVENTION

This invention concerns silver halide photographic emulsions, and in particular it concerns a technique for markedly improving the rate of silver halide grain development, speed(sensitivity)/fog ratio, and roller marks when processing is performed in an automatic processor, especially for photographic light-sensitive materials which are suitable for ultra-rapid automatic development processing with a dry to dry time of not more than 60 seconds.

BACKGROUND OF THE INVENTION

In recent years, high temperature rapid processing has become widespread for the development processing of photographic light-sensitive materials (referred to hereinafter as photosensitive materials) and the processing time for an automatic processor for various types of photosensitive material has been greatly reduced. The achievement of rapid processing requires a developer which provides an adequate density in a short period of time, particularly for a photosensitive material which has excellent development properties; which gives an adequate black density in a short period of time; and which has characteristics such that the material dries quickly after washing with water. Well-known methods to improve the drying properties of photosensitive materials include the pre-addition of an adequate quantity of film hardening agent (e.g., gelatin crosslinking agent) during the coating of the sensitive material; reducing the amount of swelling of the emulsion layer and the surface protecting layer during the course of development, fixation and water washing. Such methods reduce the water content of the sensitive material before the start of the drying process. The drying time is shortened if a large amount of film hardening agent is used in this method, but development is retarded as a result of the reduced amount of swelling, the photographic speed is reduced and gradation is softened, and the covering power is also reduced. Moreover, with high temperature rapid processing with processing agents in which the developer and fixer have essentially no gelatin hardening action, as disclosed, for example, in JP-A-63-144084, the sensitive material must be adequately film-hardened and it is impossible to realize short processing times with silver halide emulsions of which the progress of development is slow. (The term "JP-A" as used herein signifies an "unexamined published Japanese patent application".) Furthermore, even if the progress of development is improved, the retarded fixing rate, due to high film hardness, leads to problematic residual silver and residual hypo, with residual coloration due to sensitizing dyes, and this impedes any shortening of the processing time. On the other hand, methods in which the development activity of the processing liquids are increased are also known, and sometimes the amount of the main or auxiliary developing agent in the developer is increased, sometimes the developer pH is increased and sometimes the processing temperature is raised. However, all of these methods have disadvantages, such as loss of storage potential of the developer, softening of contrast even though there is an increase in speed, and a tendency to foging for example.

Alternatively, for rapid processing, there is a continued need of improvement in graininess and photographic speeds of such sensitive materials.

Increasing the grain size increases photographic speed but accordingly has an adverse effect on graininess.

Unless high photographic speeds are achieved with grains of the same size (with tabular grains, with the same projected area diameter and thickness), or unless the graininess is improved at the same photographic speed, such improvements are meaningless.

Techniques in which tabular grains are used to provide improvements of the type described above have been disclosed e.g., in U.S. Pat. Nos. 4,439,520 and 4,425,425.

Furthermore, techniques in which the rate of development and the speed/fog ratio are improved by controlling the development initiation points at the corners and/or edges, or in the vicinity of the corners and/or edges, of silver halide grains which have a (111) plane, have been disclosed in JP-A-63-305343 and Japanese Patent Application 62-152330. Moreover, photographic elements for radiographic purposes which have a high covering power by using tabular grains and which do not necessitate a film hardening agent to be added at the time of development by setting the swelling of the hydrophilic colloid layer below 200% have been disclosed in JP-A-58-111933.

As a result of thorough investigation, the inventors have discovered a technique which improves on existing techniques and enables ultra-high speed processing which could not be realized with the existing techniques to be achieved.

Thus, the use of the emulsions with which the rate of development is improved are disclosed in U.S. Pat. Nos. 4,439,520 and 4,425,425 and JP-A-63-305343 could be predicted, but the fact that a post-development drying cannot be carried out in ultra-rapid processing frequently arises. The amount of film hardening agent added was increased on the basis of the technique described in JP-A-58-111933 and preliminary film hardening was carried out so as to provide adequate drying properties in the case of ultra-rapid processing in an automatic processor. Using this sensitive material, the line speed of the automatic processor was increased and, as the dry to dry process speed was increased gradually, the drying properties were maintained at a satisfactory level, but there was a worsening in respect of the residual coloration due to sensitizing dyes; the residual silver; and residual hypo exceeded the permitted limits and fixing failure occurred. Furthermore, there was a pronounced lowering of speed and softening of contrast due to retarded development at this time. There was an improvement in the fixing properties when the preliminary film hardness level was reduced but then problems arose again with regard to drying failure.

On reducing the amounts of gelatin and hydrophilic polymeric material while maintaining the coated silver weight of the sensitive material for maintaining the photographic properties there was a marked worsening in respect of the blackening which occurred when the sensitive material was folded before processing and in respect of the roller marking which occurred where the material was transported by the rollers in an automatic processor, and this was of no practical value.

It has long been known that the fine structure of the silver halide crystals ultimately has an effect on photographic, performance. The following statement is made on page 18 of *Photographic Emulsion Chemistry,* by Duffin (Focal Press, 1966):

"In the case of a silver iodobromide emulsion, the location of the iodide is the most important factor to be considered. The iodide can be present principally in the interior of the crystals, it can be distributed uniformly throughout the whole grain, or it can be present principally on the outer surface. The actual location of the iodide is determined by the preparative conditions, and its location clearly has an effect on the physical and chemical properties of the crystal."

Silver iodobromide grains are formed with all of the iodide and bromide present in the reactor by introducing an aqueous solution of a silver salt into the reactor. In the so-called single jet method, the silver iodide precipitates first and is easily concentrated in the middle of the grains. On the other hand, with the double jet method in which both iodide and bromide are introduced into the reactor at the same time as the silver salt, the distribution of the silver iodide within the grains can be controlled intentionally. For example, the silver iodide is sometimes distributed uniformly throughout the whole of the grains or, if the addition of the bromide is reduced or stopped during the formation of the grains and the addition of the iodide is continued, it is possible to form silver iodide on the outer surface (the outside) of the grains or to form a silver iodobromide shell which has a high silver iodide content. Silver halide emulsions in which tabular silver iodobromide grains of thickness less than 0.5 μm and diameter at least 0.6 μm, average aspect ratio at least 8, account for at least 50% of the total projected area, in which the said tabular grains have first and second opposing parallel principal surfaces and a central region which extends between the said two principal surfaces, and in which the silver iodide content in the said central region is lower than the silver iodide content in the regions which are displaced transversely in at least one direction spreading to the said two principal surfaces have been disclosed in JP-A-58-113927. Silver halide emulsions in which at least 10% (of the number of grains which are present in the silver halide emulsion) are tabular grains of aspect ratio at least 5 which contain silver iodide in the interior part (corresponding to 80 mol % of the total amount of silver in the grain) inside in the long axis direction or the short axis direction of the grains (an interior high iodide phase), in which the average iodide content of the said interior high iodide phase is at least five times the average iodine content of the silver halide which is present outside the said phase, and in which the silver content of the said internal high iodide phase accounts for not more than 50 mol % of the silver in the whole grain have been disclosed in JP-A-59-99433. Moreover, silver halide photographic emulsions which contain silver halide grains having aspect ratio not more than 5 and having a multi-layer structure, the difference in the average iodine content of two layers which have respective uniform iodine distributions and which are adjacent in the said grains is not more than 10%, and in which the total silver iodide content of the silver halide grains which have the multi-layer structure is not more than 20 mol %, have been disclosed in JP-A-60-147727.

Silver halide photographic emulsions which contain silver halide grains which have a distinct layer structure of which the distinguishing features are that they are comprised of a core part which contains from 10 to 45 mol % of silver iodide and a shell part which contains not more than 5 mol % of silver iodide and that the average silver iodide content is at least 7 mol % have been disclosed in JP-A-60-14331. Moreover, silver halide emulsions of which the distinguishing features are that they have a plural layer structure in which the silver iodide contents differ, that the silver iodide content of the outermost shell is not more than 10 mol %, that a shell which has a silver iodide content at least 6 mol % higher than that of the aforementioned outermost shell is established on the inside of the aforementioned outermost shell, and that an intermediate shell which has a silver iodide content which is between those of the said outermost shell and the aforementioned high silver iodide content shell is established have been disclosed in JP-A-61-245151. The details disclosed in these patents indicate that better photographic properties can be obtained by changing the silver iodide content in the individual grains according to the location (and especially in terms of the inside and the outside of the grains).

On the other hand, Y. T. Tan and R. C. Baetzold announced at the 41st annual conference of Society of Photographic Science & Engineering that they had calculated the energy states of the silver halides and hypothesized that the iodide in silver iodobromide crystal grains tended to form clusters. The distribution of silver iodide in the tabular silver iodobromide grains described earlier is such that the silver iodide content changes in different portions in units of from 300 to 1000 angstroms, but according to the conjectures of Y. T. Tan and R. C. Baetzold, a more microscopic non-uniform silver iodide distribution is confirmed within the silver iodobromide crystals.

These existing photographic silver halide emulsions were inadequate with respect to photographic speed and their suitability for ultra-rapid processing.

SUMMARY OF THE INVENTION

Accordingly, one object of the present invention is to provide silver halide photographic emulsions in which the rate of development is increased, which have an excellent speed/fog ratio and of which the covering power is high compared with known tabular grain emulsions of the same projected area diameter and the same thickness.

Another object of the present invention is to overcome the above described difficulties of the prior art and to provide a sensitive material which has high photographic speed and excellent development progression properties, and which is suitable for ultra-rapid processing, which it has not been possible to realize in the past.

According to the present invention, a method is provided for producing silver halide emulsions comprising silver iodobromide or iodobromochloride grains having an average iodine content of less than 1.0 mol %, said method comprising the following step (a) or (b) to form a surface portion of the grains such that said step provides the surface portion having an iodine content of 0.005 mol % to less than 0.3 mol % based on the total amount of silver in the grains:

(a) adding simultaneously a silver nitrate solution and a solution which contains iodine ion; or (b) adding fine particles of AgI and/or fine particles of AgBrI.

DETAILED DESCRIPTION OF THE INVENTION

The powder X-ray diffraction method as disclosed, for example, in JP-A-56-110926 can be used for measuring the halogen composition of silver halide emulsion grains, but the halogen composition distribution between grains and the halogen composition within a grain cannot be discriminated in principle with this method. Hence, since only the halogen composition of the silver halide emulsion grains is analyzed by means of the powder X-ray diffraction method, it was difficult to obtain systematically a design policy for emulsions in which the halogen composition distribution between the silver halide emulsion grains is specified. Thus, the inventors investigated the halogen composition of individual emulsion grains in a silver halide emulsion using various methods as described below.

The silver iodide content of individual emulsion grains can be measured by analyzing the compositions of the silver halide grains one by one using an X-ray microanalyzer for example.

The results obtained on measuring the silver iodide content for the internal structures of individual silver halide grains using an analytical electron microscope have been reported on pages 125–128 of *J. Soc. Photogr. Sci. Technol. Japan,* volume 53, number 2, 1990.

A means of examining the fine structure within a grain in connection with the halogen composition of tabular grains using low temperature luminescence microscopy has been reported in detail on pages 15–26 of the *Journal of Imaging Science,* volume 31, number 1, 1987.

Furthermore, the fact that the silver iodide determines the site for the deposition of the silver chloride (i.e. provides site direction) when silver chloride is deposited on silver iodobromide which has a silver iodide distribution within the grains is reported in detail on pages 160–177 of *Journal of Imaging Science,* volume 32, number 4, 1988.

Moreover, the fact that the irregularity of the halogen composition within a grain can be observed by observing the grains directly at low temperature using a transmission type electron microscope has been reported on pages 2–13 of *J. Soc. Photogr. Sci. Technol. Japan,* volume 35 number 4, 1972.

Using methods such as those described above, it is possible to observe the fine structure of the silver halide composition of individual silver halide grains.

The emulsion grains used in the present invention are described below.

The silver halide photographic emulsions which can be used in the present invention can be prepared with reference to the methods described, for example, in *Research Disclosure* number 17643 (Dec. 1978), pages 22 to 23, I- Emulsion Preparation and Types) and *Research Disclosure* number 18716 (Nov. 1979), page 648, and *Research Disclosure* number 307105 (Nov. 1989), pages 863–865, and by P. Glafkides in *Chemie et Physique Photographique,* Paul Montel, 1967, by G. F. Duffin in *Photographic Emulsion Chemistry,* (Focal Press, 1966) and by V. L. Zelikman et al. in *Making and Coating Photographic Emulsions,* (Focal Press, 1964) the entire contents of which references are incorporated by reference.

The silver halide grains of the emulsion of the present invention are composed of silver iodobromide or silver iodobromochloride having an average silver iodide content in all of the grains must ultimately be less than about 1 mol %. When forming the final grain surfaces, the iodine is preferably supplied in such a way that there is no inter-particle distribution of the surface iodine content of the individual grains.

Now, the grain prior to the formation of the final grain surface is called the basic grain. The basic grains may have a uniform halogen composition, or they may be double structure grains or multi-layer structure grains with more than two layers of the type which has a high iodine layer inside the grain or conversely of the type in which the outside of the grain has a higher iodine content than the interior, but double structure grains which have a high iodine layer within the grain are preferred. However, the final average iodine content of the grains after forming the grain surfaces must be less than 1 mol %, preferably less than 0.7 mol %, and most desirably less than 0.5 mol %.

The method of forming the grain surface silver iodobromide layer is described below. Thus, when forming the final grain shell, the iodine is preferably supplied in such a way that there is no inter-grain distribution of the shell iodine content of the individual grains. The so-called halogen conversion method as disclosed, for example, in British Patent 635,841 or U.S. Pat. No. 3,622,318 can be used for forming the grain surface silver iodobromide layer, but with this simple method an inter-grain distribution of the surface iodine content of the individual grains is liable to occur and the effect of the present invention is not achieved efficiently. The inter-grain distribution of the surface iodine content of the grains of a silver halide photographic emulsion of the present invention is preferably such that the variation coefficient is not more than 25%, and particularly preferably not more than 20%. The variation coefficient of the surface iodide contents of the grains is the value obtained on dividing the standard deviation of the silver iodide content obtained on measuring the surface iodide content of at least 100 emulsion grains by ion scatting spectroscopy for example by the average silver iodide content and multiplying the result obtained by 100.

In methods wherein a silver nitrate solution and an iodine ion containing solution are added simultaneously; methods wherein fine silver halide particles of composition AgI and/or AgBrI are added; and methods wherein a mixture is obtained by dissolving potassium iodide or potassium iodide and potassium bromide in a gelatin solution, cooling and setting is added can be used, for example, as methods for forming the grain surface silver iodobromide layer. From among these methods, those in which a silver nitrate solution and an iodine ion containing solution are added simultaneously, and those in which fine silver halide particles of composition AgI and/or AgBrI are added, are preferred in the present invention.

When forming the grain shell silver iodobromide layer of the present invention, the average iodine content of the said grain surface must be higher than the iodine content of the inside layer which is adjacent thereto. Hence, in those cases where a silver nitrate solution and a mixed solution of potassium iodide and potassium bromide are added and in those cases where fine AgBrI grains are added, the iodine content of the added material must be higher than the iodine content of the basic grains. The average iodine content of the grain surface is preferably at least twice, and most desirably at least five times, the iodine content of the layer adjacent thereto on the inside. The average iodine content of the grain surface which is formed is at least 0.1 mol % but less than 20 mol %, preferably at 0.2 mol % but less than 15 mol %, and most desirably at least 0.5 mol % but less about 10 mol %.

The term "grain surface" used herein means a portion (shell) of up to 3 atom-depth from the surface of the grains, and the iodine content of the grain surface (sometimes referred to as "surface iodine content") can be measured by ion scatting spectroscopy as described in D. P. Smith *J. Appl. Phys.*, Vol. 38, p.340 (1967); E. Taglauer and W. Heiland, *Appl. Phys.*, Vol. 9, p.261 (1976); W. Heiland, *Appl. Surf. Sci.*, Vol.13, p.282 (1982); and T. M. Buck, *Methods of Surface Analysis*, ed, A. W. Czanderna (Flsevier, Amsterdam, 1975).

The amount of iodine supplied when forming a grain surface silver iodobromide layer of the present invention is 0.005 mol % to less than 0.3 mol %, preferably 0.01 mol % to less than 0.2 mol %, and most desirably 0.02 mol % to less than 0.1 mol %.

In cases where fine silver halide particles of composition AgI and/or AgBrI are added, the particles size is not more than 0.5 μm, preferably not more than 0.2 μm, and most desirably not more than 0.1 μm.

Known silver halide solvents are preferably used when forming the grain surface silver iodobromide layer of the present invention. Preferred silver halide solvents include thioether compounds, thiocyanate, tetra-substituted thiourea and aqueous ammonia solution. From among these, the thioether compounds and thiocyanate are preferred, and thiocyanate is preferably used in an amount of from 0.5 to 5 grams per mol of silver halide and thioether compounds are preferably used in amounts of from 0.2 to 3 grams per mol of silver halide.

The average size of the corresponding spheres of the same volume as the basic grains used in the present invention is preferably at least 0.3 μm. A size of from 0.4 to 2.0 μm is preferred, and a narrow grain size distribution is also preferred.

The silver halide grains in the emulsion may have a regular crystalline form such as cubic or octahedral form, or they may have an irregular crystalline form such as a spherical, plate-like or potato-like form, or they may have a complex form which is composite of these crystalline forms, or they may be comprised of mixtures of grains which have various crystalline forms. Furthermore, tabular grains of which the grain diameter is at least about five times the grain thickness are preferably used for the present invention (disclosed in detail in *Research Disclosure* volume 225, item 22534, pages 20–58, January 1983, and in JP-A-58-113926).

The methods known in the industry can be combined suitably for the method of manufacturing tabular silver halide grains.

Tabular silver halide emulsions have been disclosed by Cugnac and Chateau in a paper entitled "Evolution of the Morphology of Silver Bromide Crystals During Physical Ripening" in *Science et Industrie Photographique*, volume 33, 1962, pages 121–125, on pages 66–72 of *Photographic Emulsion Chemistry* edited by Duffin (Focal Press, New York, 1966) and by A.P.H. Trivelli and W. D. Smith in *Phot. Journal*, volume 80 (1940), page 285, and they can be prepared easily with reference to the methods disclosed in JP-A-58-127921, JP-A-58-113927, JP-A-58-113928 and U.S. Pat. No. 4,439,520.

The presence of a substance which is adsorbed on silver halide in an amount of at least 0.5 mmol per mol of silver halide is desirable during chemical sensitization during the process of preparing the emulsion, as disclosed in JP-A-2-68539 in order to make effective use of the effect of the present invention. The substance which is adsorbed on silver halide may be added at any stage during grain formation, immediately after grain formation or after the start of post ripening, for example, but the adsorbed substance is preferably added before the addition of the chemical sensitizing agent (for example, gold or sulfur sensitizing agent), or together with the chemical sensitizing agent, and the adsorbed substance must be present at least during the course of chemical sensitization.

The conditions for the addition of the substance which is adsorbed on silver halide preferably include an temperature within the range from 30° C. to 80° C., but a temperature within the range from 50° C. to 80° C. is preferred for the purposes of stronger adsorption. The pH and pAg values can also be fixed arbitrarily, but a pH of from 6 to 10 and a pAg of from 7 to 9 are preferred when carrying out chemical sensitization according to the present invention.

The substances which are adsorbed on silver halide according to the present invention are sensitizing dyes or substances which function as stabilizers of photographic performance.

Thus, many compounds which are known as anti-foggants or stabilizers, such as azoles {for example, benzothiazolium salts, benzimidazolium salts, imidazoles, benzimidazoles, nitroimidazoles, triazoles, benzotriazoles, tetrazoles and triazines}; mercapto compounds {for example, mercaptothiazoles, mercaptobenzothiazoles, mercaptoimidazoles, mercaptobenzimidazoles, mercaptobenzoxazoles, mercaptothiadiazoles, mercapto-oxadiazoles, mercaptotetrazoles, mercaptotriazoles, mercaptopyrimidines and mercaptotriazines}; thioketo compounds such as oxazolinethione, for example; and azaindenes {for example, triazaindenes, tetra-azaindenes (especially 4-hydroxy substituted (1,3,3a,7)tetra-azaindenes) and penta-azaindene} can be used as substances which are adsorbed onto silver halide grains.

Moreover, purines and nucleic acids, or the macromolecular compounds disclosed, for example, in JP-B-61-36213 and JP-A-59-90844 can also be used as adsorbable substances. (The term "JP-B" as used herein signifies an "examined Japanese patent publication".)

From among these compounds, the use of the azaindenes, and the purines and nucleic acids, is preferred in the present invention. These compounds are added in amounts of from 30 to 300 mg, and preferably in amounts of from 50 to 250 mg, per mol of silver halide.

The desired effect can be realized using sensitizing dyes for the substance which is adsorbed on silver halide in the present invention.

Cyanine dyes, merocyanine dyes, complex cyanine dyes, complex merocyanine dyes, holopolar cyanine dyes, styryl dyes, hemi-cyanine dyes, oxonol dyes and hemi-oxonol dyes, for example, can be used as sensitizing dyes.

Sensitizing dyes which can be used in the present invention have been disclosed, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, JP-A-48-76525, and Belgian Patent 691,807. The sensitizing dyes preferably are added in amounts of at least 300 mg but less than 2000 mg, and preferably of at least 500 mg but less than 1000 mg, per mol of silver halide.

Actual examples of sensitizing dyes which are effective in the present invention are indicated below.

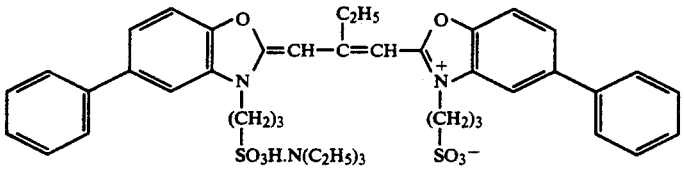

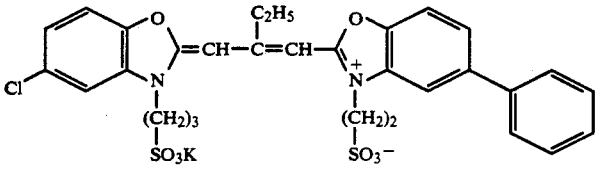

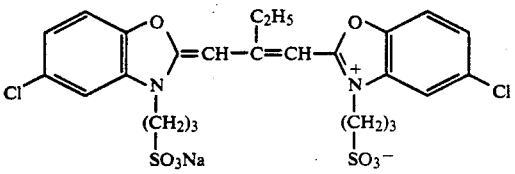

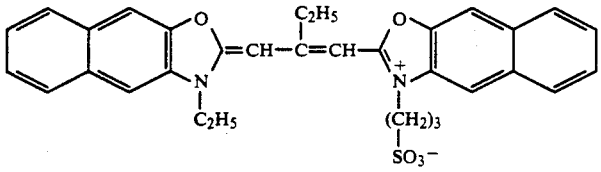

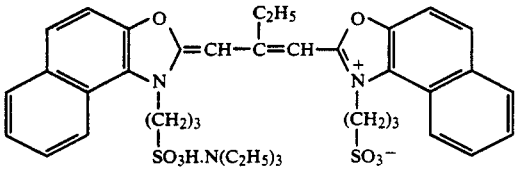

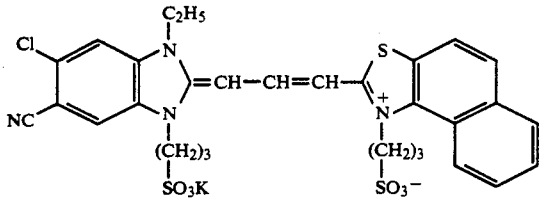

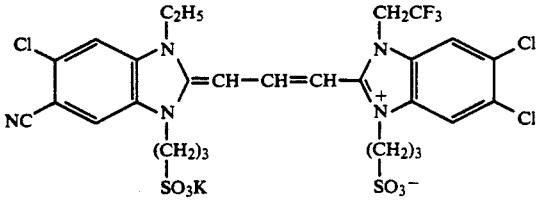

Preferred cyanine dyes are from among the above mentioned dyes. It is also preferred that such cyanine dyes and the aforementioned stabilizing agents are used conjointly.

Sensitizing dyes used in the present invention may be added during the interval after chemical sensitization and before coating.

The projected area diameter of a tabular emulsion of the present invention is preferably from 0.3 to 2.0 μm and most desirably from 0.5 to 1.2 μm. Furthermore, the distance between the parallel planes of the (the grain thickness) is preferably from 0.05 μm to 0.3 μm and most desirably from 0.1 μm to 0.25 μm, and the aspect ratio is preferably at least 3 but less than 20 and most desirably at least 4 and less than 8. In a tabular silver halide emulsion of the present invention, silver halide grains of which the aspect ratio is at least 2 account for at least 50% (projected area), and especially at least 70%, of all the grains, and the aspect ratio of the tabular grains is preferably at least 3 and most desirably from 4 to 8.

Mono-disperse hexagonal tabular grains are preferred from among the tabular silver halide grains.

The structure and preparation of mono-disperse hexagonal tabular grains as referred to in the present invention are known, e.g., as disclosed in JP-A-63-151618.

Known methods of sensitization, such as sulfur sensitization methods, selenium sensitization methods, reduction sensitization methods and gold sensitization methods for example, can be used in the presence of the aforementioned substances which are adsorbed onto silver halides for the chemical sensitization of a silver halide emulsion which can be used in the present invention, and these methods may be used individually or in combination.

The gold sensitization method is typical of the precious metal sensitization methods, and in this case gold compounds, principally gold complex salts, are used. Complex salts of precious metals other than gold, for example, of platinum, palladium and iridium for example, can also be used. Actual examples have been disclosed, for example, in U.S. Pat. No. 2,448,060 and British Patent 618,061.

As well as sulfur compounds which are contained in gelatin, a variety of other sulfur compounds, such as thiosulfate, thioureas, thiazoles and rhodanines for example, can be used as sulfur sensitizing agents. Actual examples have been disclosed in U.S. Pat. Nos. 1,574,944, 2,278,947, 2,410,689, 2,728,668, 3,501,313 and 3,656,955.

The effect of the present invention can be preferably realized with the use of sulfur sensitization with thiosulfate in combination with gold sensitization.

Stannous salts, amines, formamidinesulfinic acid and silane compounds, for example, can be used as reduction sensitizing agents.

Various compounds other than the substances which are adsorbed on silver halides in the chemical sensitization processes used in the present invention can be included in a photographic emulsion which are used in the present invention to prevent the occurrence of fogging during the manufacture, storage or photographic processing of photosensitive materials or to stabilize photographic performance. That is to say, many compounds which are known as anti-foggants or stabilizers, such as azoles {for example, benzothiazolium salts, nitroimidazoles, nitrobenzimidazoles, chlorobenzimidazoles, bromobenzimidazoles, nitroindazoles, benzotriazoles and aminotriazoles}; mercapto compounds {for example, mercaptothiazoles, mercaptobenzothiazoles, thiazoles, mercaptobenzimidazoles, mercaptothiadiazoles, mercaptotetrazoles,mercaptopyrimidinesandmercaptotriazines}; thioketo compounds such as oxazolinethione for example; azaindenes {for example, triazaindenes, tetra-azaindenes (especially 4-hydroxy substituted (1,3,3a,7)tetra-azaindenes) and penta-azaindene}; benzenethiosulfonic acid, benzenesulfinic acid and benzenesulfonic acid amide, can be added according to the present invention.

The use of the nitrones and derivatives thereof disclosed in JP-A-60-76743 and JP-A-60-87322, mercapto compounds disclosed in JP-A-60-80839, heterocyclic compounds and heterocyclic compound silver complex salts (for example 1-phenyl-5-mercaptotetrazole silver) disclosed in JP-A-57-164735, for example, are especially desirable. Spectrally sensitizing dyes for other wavelength regions may be added, as required, as substances which are adsorbed on the silver halide in the chemical sensitization process.

The photographic emulsions of the present invention are used in preparation of photosensitive materials which comprises a support having thereon a photographic emulsion layer and optionally other hydrophilic colloid layers.

Various surfactants can be included in the photographic emulsion layers and other hydrophilic colloid layers of the photosensitive material as coating promotors, for anti-static purposes, for improving slip properties, for emulsification and dispersion purposes, for preventing the occurrence of sticking and for improving photographic characteristics (for example, for accelerating development, as film hardening agents and for increasing photographic speed).

Examples of surfactants include non-ionic surfactants such as saponin (steroid based), alkylene oxide derivatives (for example, polyethylene glycol, polyethylene glycol/polypropylene glycol condensate, polyethylene glycol alkyl ethers, polyethylene glycol aryl alkyl ethers, and poly(ethylene oxide) adducts of silicones), and alkyl esters of saccharose; anionic surfactants such as alkylsulfonates, alkylbenzenesulfonates, alkylnaphthalenesulfonates, alkylsulfate esters, N-acyl-N-alkyltaurines, sulfosuccinate esters, and sulfoalkylpolyoxyethylene alkylphenyl ethers; amphoteric surfactants such as alkylbetaines and alkylsulfobetaines; and cationic surfactants such as aliphatic or aromatic quaternary ammonium salts, pyridinium salts, and imidazolium salts.

From among these surfactants, the use of the anionic surfactants such as sodium dodecylbenzenesulfonate, sodium di-2-ethylhexyl-α-sulfosuccinate, sodium p-octylphenoxyethoxyethanesulfonate, sodium dodecylsulfate, sodium tri-isopropylnaphthalenesulfonate, and N-methyl-oleoyltaurine sodium salt, the cationic surfactants such as dodecyl tri-methyl ammonium chloride, N-oleoyl-N',N',N'-trimethyl ammoniodiaminopropane bromide and dodecyl-N,N-dimethylcarboxybetaine, N-oleyl-N,N-dimethylsulfobutylbetaines, and the non-ionic surfactants such as saponin, poly (average degree of polymerization (n) 10) oxyethylene cetyl ether, poly (n=25) oxyethylene p-nonylphenyl ether and bis(1-poly (n=15) oxyethylene-oxy-2,4-di-tert-pentylphenyl)ethane is preferred.

The use of fluorine-containing surfactants such as potassium perfluorooctanesulfonate, N-propyl-N-perfluorooctanesulfonylglycine sodium salt, N-propyl-N-perfluorooctanesulfonylaminoethyloxy poly (n=3) oxyethylene butane sulfonic acid sodium salt, N-perfluorooctanesulfonyl-N',N',N'-trimethylammoniodiaminopropane chloride, and N-perfluorodecanoylaminopropyl-N',N'-dimethyl-N'-carboxybetaine, non-ionic surfactants as disclosed, for example, in JP-A-60-80848, JP-A-61-112144, JP-A-62-172343 and JP-A-62-173459, the nitrates of alkali metals, electrically conductive tin oxide, zinc oxide, vanadium pentoxide and complex oxides in which these have been doped with antimony for example, as anti-static agents, is preferred.

Homopolymers of methyl methacrylate or copolymers of methyl methacrylate and methacrylic acid, as disclosed in U.S. Pat. Nos. 2,992,101, 2,701,245, 4,142,894 and 4,396,706, organic compounds such as starch for example, and fine particles of inorganic compounds such as silica, titanium dioxide and strontium barium sulfate for example, can be used as matting agents in the present invention.

The particle size is preferably from 1.0 to 10 μm, and most preferably from 2 to 5 μm.

As well as the silicone compounds disclosed, for example, in U.S. Pat. Nos. 3,489,576 and 4,047,958 and the colloidal silica as disclosed in JP-B-56-23139, paraffin wax, higher fatty acid esters and starch derivatives, for example, can be used as slip agents in the surface layer of a photosensitive material of the present invention.

Polyols such as trimethylolpropane, pentanediol, butanediol, ethylene glycol and glycerine, for example, can be used as plasticizers in the hydrophilic colloid layers of a photosensitive material of the present invention.

Gelatin is useful as the binding agent or protective colloid which is used in the emulsion layers, intermediate layers and surface protective layers of a photosensitive material of the present invention, but use can also be made of other hydrophilic colloids.

For example, use can be made of gelatin derivatives, graft polymers of gelatin with other macromolecules, proteins such as albumin and casein, cellulose derivatives such as hydroxyethylcellulose, carboxymethylcellulose and cellulose sulfate esters, sodium alginate, sugar derivatives such as dextran and starch derivatives, and many synthetic macromolecular substances such as homopolymers, for example poly(vinyl alcohol), partially acetalated poly(vinyl alcohol), poly(N-vinylpyrrolidone), poly(acrylic acid), poly(methacylic acid), polyacrylamide, polyvinylimidazole and polyvinylpyrazoles, and copolymers thereof.

As well as lime treated gelatin, acid treated gelatins and enzyme treated gelatins can be used for the gelatin, and hydrolyzates and enzyme degradation products of gelatin can also be used.

From among these materials, the combined use of gelatin and polyacrylamide or dextran of average molecular weight not more than about 50,000 is preferred. The methods disclosed in JP-A-63-68837 and JP-A-63-149641 are also effective in the present invention.

It is preferred that the total amount of gelatin coated on one side of a support of the photosensitive material is within the range of 1.8 to 2.8 g/m$^2$.

Inorganic or organic film hardening agents may be included in the photographic emulsion layers and in the non-photosensitive hydrophilic colloid layers of the present invention. For example, chromium salts (for example chrome alum, chromium acetate), aldehydes (for example, formaldehyde, glyoxal, glutaraldehyde), N-methylol compounds (for example, dimethylolurea, methyloldimethylhydantoin), dioxane derivatives (for example, 2,3-dihydroxydioxane), active vinyl compounds (for example, 1,3,5-triacryloyl-hexahydro-s-triazine, bis(vinylsulfonyl)methyl ether, N,N'-methylene-bis-[β(vinylsulfonyl)propionamide]), active halogen compounds (for example, 2,4-dichloro-6-hydroxy-s-triazine), mucohalogen acids (for example, mucochloric acid, mucophenoxychloric acid), isooxazoles, dialdehyde starch, and 2-chloro-6-hydroxytriazinylized gelatin can be used either individually or in combinations. From among these, the active vinyl compounds disclosed in JP-A-53-41221, JP-A-53-57257, JP-A-59-162546 and JP-A-60-80846 and the active halogen compounds as disclosed in U.S. Pat. No. 3,325,287 are preferred.

Polymeric film hardening agents can also be used effectively as film hardening agents in the present invention.

Examples of the polymeric film hardening agents which can be used in the present invention include dialdehyde starch, polyacrolein, the polymers which have aldehyde groups such as the acrolein copolymers disclosed in U.S. Pat. No. 3,396,029, the polymers which have an epoxy group disclosed in U.S. Pat. No. 3,623,878, the polymers which have dichlorotriazine groups as disclosed, for example, in U.S. Pat. No. 3,362,827 and *Research Disclosure* 17333 (1978), the polymers which have active ester groups disclosed in JP-A-56-66841, the polymers which have active vinyl groups or precursors thereof as disclosed, for example, in JP-A-56-142524, U.S. Pat. No. 4,161,407, JP-A-54-65033 and *Research Disclosure*, 16725 (1978), and the polymers which have active vinyl groups or precursors thereof are preferred, and from among these, the polymers in which the active vinyl groups or precursors thereof are bonded to the main polymer chain with long spacer groups as disclosed in JP-A-56-142524 are especially desirable.

The swelling factor in water with these film hardening agents of the hydrophilic colloid layers in a photosensitive material of the present invention is preferably not more than 300%, and film hardening such that the swelling factors is from 200 to 270% is most desirable.

A poly(ethylene terephthalate) film or a cellulose triacetate film is preferred for the support.

The methods in which the surface of the support is subjected to a corona discharge treatment or a glow discharge treatment or irradiation with ultraviolet is desirable for increasing the strength of adhesion of the hydrophilic colloid layer, or an under-layer comprised of a styrene-butadiene based latex or a vinylidene chloride based latex may be established on the support, and a gelatin layer may be established on this layer.

Furthermore, under-layers in which organic solvents which contain polyethylene swelling agents and gelatin are used may be established. These under-layers can be subjected to surface treatment and the strength of adhesion of the hydrophilic colloid layer can be further improved.

Plasticizers such as polymers or emulsified substances can be included in the emulsion layers of a photosensitive material of the present invention in order to improve the pressure characteristics.

For example, a method in which heterocyclic compounds are used has been disclosed in British Patent 738,681, a method in which alkyl phthalates are used has been disclosed in British Patent 738,637, a method in which alkyl ether is used has been disclosed in British Patent 738,639, a method in which poly-hydric alcohols are used has been disclosed in U.S. Pat. No. 2,960,404, a method in which carboxyalkylcellulose is used has been disclosed in U.S. Pat. No. 3,121,060, a method in which paraffin and carboxylic acid salts are used has been disclosed in JP-A-49-5017 and a method in which alkyl acrylate and organic acid is used has been disclosed in JP-B-53-28086.

No particular limitation is imposed upon the structure other than the emulsion layers of a silver halide photographic light-sensitive material of the present invention, and various additives can be used as required. For example, use can be made of the binders, surfactants, other dyes, ultraviolet absorbers, coating promotors and thickeners which are disclosed, e.g., on pages 22 to 28 of *Research Disclosure* volume 176 (December 1978).

The invention is described in practical terms below by means of illustrative examples. Unless otherwise indicated, all percents, ratios and the like are by weight.

EXAMPLE 1

(1) Preparation of Fine Grained AgI

Potassium iodide (0.5 grams) and 26 grams of gelatin were added to 2 liters of water and 80 cc of an aqueous solution which contained 40 grams of silver nitrate and 80 cc of an aqueous solution which contained 39 grams of potassium iodide were added, with stirring, to the solution which was being maintained at 35° C. over a period of 5 minutes. At this time the rates of addition of the aqueous silver nitrate solution and the aqueous potassium iodide solution were accelerated linearly in such a way that the rate of addition at the start of the addition was 8 cc per minute and the addition of 80 cc was completed in 5 minutes.

After forming grains in this way, the soluble salts were removed using the sedimentation method at 35° C. Next, the temperature was raised to 40° C., 10.5 grams of gelatin and 2.56 grams of phenoxyethanol were added and the pH was adjusted to 6.8 using caustic soda. The emulsion so obtained had a total weight of 730 grams and consisted of mono-disperse fine grains of AgI of average diameter 0.015 μm.

(2) Preparation of the Octahedral Emulsions for Comparison and of the present Invention Potassium bromide (0.35 gram) and 20.6 grams of gelatin were added to 1 liter of water and then 40 cc of an aqueous silver nitrate solution (0.28 gram as silver nitrate) and 40 cc of an aqueous potassium bromide solution (0.21 gram as potassium bromide) were added, with stirring, to this solution which was being maintained at 50° C. over a period of 10 minutes using the double jet method. Next, 200 cc of an aqueous silver nitrate solution (1.42 grams as silver nitrate) and 200 cc of an aqueous potassium bromide solution (1.06 grams as potassium bromide) were added simultaneously over a period of 8 minutes, followed by further addition of 27 cc of an aqueous potassium bromide solution (2.7 grams as potassium bromide). Subsequently, an aqueous solution of silver nitrate and an aqueous solution of potassium bromide were added again using the controlled double jet method. The aqueous solution of silver nitrate which was added amounted to 1 liters (140 grams of silver nitrate) and this was added at a rate of 2 cc/minute at the start of the addition and the rate of addition was accelerated linearly in such a way that the addition was completed in 70 minutes. The aqueous potassium bromide solution was added simultaneously in such a way that the control potential was limited so that the pAg value was 8.58.

Mono-disperse pure silver bromide octahedral grains of diameter 0.62 μm were formed in this way.

Subsequently, a silver iodide layer was formed on the grain surface in the ways indicated below.

Comparative Octahedral Emulsion OCT-1

The pure silver bromide was left as it was, and no iodine at all was deposited on the surface.

Comparative Octahedral Emulsion OCT-2

A 1% aqueous KI solution corresponding to 0.4 mol % with respect to the total amount of silver was added over 5 minutes.

Comparative Octahedral Emulsion OCT-3

A 1% aqueous KI solution corresponding to 0.25 mol % with respect to the total amount of silver was added over 5 minutes.

Comparative Octahedral Emulsion OCT-4

A 1% aqueous KI solution corresponding to 0.1 mol % with respect to the total amount of silver was added over 5 minutes.

Comparative Octahedral Emulsion OCT-5

The fine AgI grains prepared in (1) (0.4 mol % with respect to the total amount of silver) were added and the mixture was physically ripened for 5 minutes.

Octahedral Emulsion of the Invention OCT-6

The fine AgI grains prepared in (1) (0.25 mol % with respect to the total amount of silver) were added and the mixture was physically ripened for 5 minutes.

Octahedral Emulsion of the Invention OCT-7

The fine AgI grains prepared in (1) (0.1 mol % with respect to the total amount of silver) were added and the mixture was physically ripened for 5 minutes.

Octahedral Emulsion of the Invention OCT-8

A 1% aqueous silver nitrate solution and a 1% aqueous KI solution were added in amounts of 0.25 mol %, respectively, with respect to the total amount of silver over a period of 5 minutes using the double jet method.

Subsequently, the temperature was reduced to 35° C. and the soluble salts were removed using the sedimentation method. The temperature was then raised to 40° C. 35 grams of gelatin, 2.35 grams of phenoxyethanol and 0.8 grams of sodium polystyrenesulfonate as thickener were added and the pH was adjusted to 6.0 with caustic soda.

(3) Preparation of Tabular Emulsions for Comparison and of this Invention

Potassium bromide (9.0 grams), 12 grams of gelatin and 2.5 cc of a 5% aqueous solution of the thioether $HO(CH_2)_2S(CH_2)_2S(CH_2)_2OH$ were added to 1 liter of water and 37 cc of an aqueous silver nitrate solution (3.43 grams as silver nitrate) and 33 cc of an aqueous solution which contained 3.22 grams of potassium bromide were added to this solution which was being maintained at 45° C., with stirring, over a period of 37 seconds using the double jet method. Next, the temperature was raised to 70° C. and 90 cc of an aqueous silver nitrate solution (8.33 grams of silver nitrate) was added over a period of 22 minutes. Here, 9 cc of 25% aqueous ammonia was added and the mixture was physically ripened for 15 minutes at the same temperature, after which 8.4 cc of a 100% acetic acid solution was added. Then, an aqueous solution of 129.9 grams of silver nitrate and an aqueous solution of potassium bromide were added over a period of 35 minutes using the controlled double jet method while maintaining a pAg value of 8.51, Mono-disperse tabular grains of average projected area diameter 1.02 μm, thickness 0.180 μm and variation coefficient 16.5% were formed in this way. A silver iodide layer was subsequently formed on the grain surface in the ways indicated below.

Comparative Tabular Grains T-1

The pure silver bromide was left as it was and no iodine at all was deposited on the surface.

Comparative Tabular Emulsion T-2

A 1% aqueous KI solution corresponding to 0.4 mol % of the total amount of silver was added over 5 minutes.

Comparative Tabular Emulsion T-3

A 1% aqueous KI solution corresponding to 0.12 mol % of the total amount of silver was added over 5 minutes.

Comparative Tabular Emulsion T-4

A 1% aqueous KI solution corresponding to 0.05 mol % of the total amount of silver was added over 5 minutes.

Comparative Tabular Emulsion T-5

The fine AgI grains prepared in (1) (0.4 mol % of the total amount of silver) were added and the mixture was physically ripened for 5 minutes.

Tabular Emulsion of the Invention T-6

The fine AgI grains prepared in (1) (0.12 mol % of the total amount of silver) were added and the mixture was physically ripened for 5 minutes.

Tabular Emulsion of the Invention T-7

The fine AgI grains prepared in (1) (0.05 mol % of the total amount of silver) were added and the mixture was physically ripened for 5 minutes.

Tabular Emulsion of the Invention T-8

A 1% aqueous silver nitrate solution and a 1% aqueous KI solution were added in amounts of 0.12 mol %, respectively, of the total amount of silver over a period of 5 minutes using the double jet method.

Subsequently, the temperature was reduced to 35° C and the soluble salts were removed using the sedimentation method. The temperature was then raised to 40° C., 35 grams of gelatin, 2.35 grams of phenoxyethanol and 0.8 grams of sodium polystyrenesulfonate as thickener were added and the pH was adjusted to 6.0 with caustic soda.

(4) Measurement of Average Iodine Content of The Grains

The above mentioned silver halide emulsions were taken and the average iodine content of the grains in each emulsion was measured using an X-ray microanalyzer (EPM 810 Type, manufactured by SHIMADZU CORPORATION). The results obtained are shown in Table 1.

(5) Preparation of Coated Samples

The reagents indicated below were added per mol of silver halide to the emulsions OCT-1 to T-8 described above to form coating liquids.

Coated Samples 1-16

| | |
|---|---|
| 2,6-Bis(hydroxyamino)-4-diethylamino-1,3,5-triazine | 72 mg |
| Trimethylolpropane | 9 grams |
| Dextran (average molecular weight 39,000) | 18.5 grams |
| Poly(potassium styrenesulfonate) (average molecular weight 600,000) | 1.8 grams |
| Film Hardening Agent 1,2-Bis(vinylsulfonylacetamido)ethane | 1.08 grams |

Coated Samples 17-32

The sensitizing dye indicated below was added in an amount of 600 mg per mol of silver to Coated Samples 1-16.

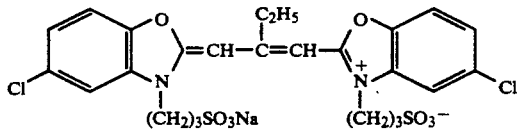

Preparation of the Surface Protective Layer Coating Liquid

The surface protective layer was prepared from the components indicated below in the coated weights shown below.

| Content of the Surface Protective Layer | Coated Weight ($g/m^2$) |
|---|---|
| Gelatin | 0.966 |
| Poly(sodium acrylate) (average molecular weight 400,000) | 0.023 |
| $C_8H_{17}$—(C6H4)—$(OCH_2CH_2)_5SO_3Na$ | 0.013 |
| $C_{16}H_{33}O—(CH_2CH_2O)_{10}—H$ | 0.045 |
| $C_{17}H_{33}CON(CH_3)CH_2CH_2SO_3Na$ | 0.0065 |
| $C_8F_{17}SO_2N(C_3H_7)—(CH_2CH_2O)_{15}—H$ | 0.003 |
| $C_8F_{17}SO_2N(C_3H_7)—(CH_2CH_2O)_4—(CH_2)_4SO_3Na$ | 0.001 |
| Poly(methyl methacrylate) (average particle size 3.7 μm) | 0.087 |
| Proxel (Adjusted to pH 6.4 with NaOH) | 0.0005 |

An under-layer, containing 0.04 wt % of the dye of which the structure is indicated below was pre-coated onto the poly(ethylene terephthalate) of thickness 183 μm which was used as the support.

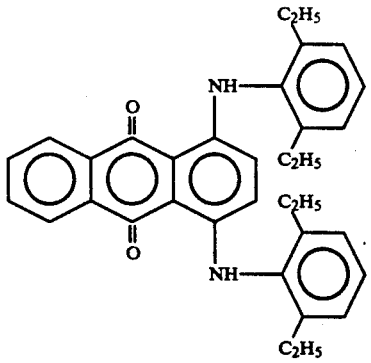

Preparation of Photosensitive Materials

The emulsion layers and the surface protective layer were coated on both sides of the aforementioned transparent support using a simultaneous extrusion method. The coated silver weight was 1.7 $g/m^2$ per side.

Photosensitive Materials 1-32 were obtained in this way.

The photosensitive materials were aged for 7 days under conditions of 25° C., 60% relative humidity (RH) and then the swelling factor of the hydrophilic colloid layer was measured. The dry film thickness (a) was obtained with a scanning type electron microscope from the cross section. The swelled film thickness (b) was obtained by freeze drying in liquid nitrogen in a state in which the photographic material had been immersed in distilled water at 21° C. for 3 minutes and then observing the material using a scanning type electron microscope.

The swelling factor was obtained using the expression:

$$\frac{(b)-(a)}{(a)} \times 100\ (\%)$$

The value for these photosensitive materials was 225%.

(6) Evaluation of Photographic Performance

Photosensitive Materials 1-32 were exposed for 0.1 second with blue light from both sides using a band pass filter BPN42 made by the Fuji Photo Film Co., Ltd. After exposure, the samples were processed in an automatic processor using the combination of developer and fixer indicated below. The photographic speed is shown as the log value of the ratio of the exposure which provided a density of 1.0, taking Photosensitive Material 1 as a standard. Here "+" indicates a speed higher than that of Photosensitive Material 1 and "−" indicates a photographic speed lower than that of Photosensitive Material 1.

Further, Photosensitive Materials 17-32 were exposed from both sides for 0.1 second using a sharp cut filter SC52 made by the Fuji Photo Film Co., Ltd. and the color sensitized speeds were evaluated. Processing was carried out in the same way as with the BPN42 filter exposures and the speed is indicated as a log representation of the ratio of the exposures required to provide a density of 0.3 taking Photosensitive Material 17 as a standard.

| Developer Concentrate | |
|---|---|
| Potassium hydroxide | 56.6 grams |
| Sodium sulfite | 200 grams |
| Diethylenetriamine pentaacetic acid | 6.7 grams |
| Potassium carbonate | 16.7 grams |
| Boric acid | 10 grams |
| Hydroquinone | 83.3 grams |
| Diethylene glycol | 40 grams |
| 4-Hydroxymethyl-4-methyl-1-phenyl-3-pyrazolidone | 22.0 grams |
| 5-Methylbenzotriazole | 2 grams |

This was made up to 1 liter with water (pH adjusted to 10.60).

| Fixer Concentrate | |
|---|---|
| Ammonium thiosulfate | 560 grams |
| Sodium sulfite | 60 grams |
| Ethylenediamine tetraacetic acid, di-sodium salt, di-hydrate | 0.10 gram |
| Sodium hydroxide | 24 grams |

This was made up to 1 liter with water (pH adjusted to 5.10 with acetic acid).

The processing liquids were charged in the way indicated below in each tank of the automatic processor at the start of development processing.

Development Tank: The above mentioned developer concentrate (333 ml), 667 ml of water and 10 ml of a starter which contained 2 grams of potassium bromide and 1.8 grams of acetic acid were added and the pH was set to 10.25.

Fixing Tank: The above mentioned fixer concentrate (250 ml) and 750 ml of water.

The FPM 9000 made by the Fuji Photo Film Co., Ltd. was modified to increase the film transport speed for the automatic processor and the dry to dry processing time was set at 30 seconds. The water washing water flowed at a rate of 3 liters per minute while the film was passing through but the flow was stopped at other times. The replenishment rates of the developer and fixer and the processing temperatures were as indicated below.

| | Temperature | Replenishment Rate |
|---|---|---|
| Development | 35° C. | 20 ml/10 × 12 inch |
| Fixing | 32° C. | 30 ml/10 × 12 inch |
| Water washing | 20° C. | 3 liter/minute |
| Drying | 55° C. | |

(7) Evaluation of Roller Marks

Photosensitive Materials 1-32 of size 10×12 inches were exposed uniformly in such a way as to provide a density of 1.0 and then they were processed under the same conditions as when evaluating photographic performance. However, on this occasion intentionally fatigued rollers were used for the transporting rollers in the developing tank and for the cross-over rollers between development and fixation. Roughness extending to ±10 μm was present on the surface of the rollers. A number of fine marks due to the roughnesses on the rollers were produced on some of the processed photosensitive materials. The state of these marks was assessed in four stages as indicated below. The results of the evaluations are shown in tables 1 and 2.

◎. . . Virtually no marks to be seen.

○. . . Fine marks produced but at a level which is of no problem in practice.

Δ. . . Marks produced but not produced with a normal roller. Tolerable level.

×. . . Many marks produced, not practical even with a normal roller.

TABLE 1

| Photo-sensitive Material | Emulsion | Iodine: Method of Addition | Iodine: Amount Added (mol %) | Average Iodine Content in Grains (mol %) | Photographic Speed ΔlogE (BPN42) | Roller Marks |
|---|---|---|---|---|---|---|
| 1 | OCT(1) | None | 0 | 0 | Standard | ◎ |
| 2 | OCT(2) | KI Solution | 0.4 | 0.4 | +0.12 | x |

TABLE 1-continued

| Photo-sensitive Material | Emulsion | Iodine: Method of Addition | Iodine: Amount Added (mol %) | Average Iodine Content in Grains (mol %) | Photographic Speed ΔlogE (BPN42) | Roller Marks |
|---|---|---|---|---|---|---|
| 3 | OCT(3) | KI Solution | 0.25 | 0.25 | +0.06 | Δ |
| 4 | OCT(4) | KI Solution | 0.1 | 0.1 | +0.03 | ○ |
| 5 | OCT(5) | AgI Fine grains | 0.4 | 0.4 | +0.16 | x |
| 6* | OCT(6) | AgI Fine grains | 0.25 | 0.25 | +0.10 | Δ |
| 7* | OCT(7) | AgI Fine grains | 0.1 | 0.1 | +0.06 | ○ |
| 8* | OCT(8) | $AgNO_3$ + KI Solution | 0.25 | 0.25 | +0.09 | Δ |
| 9 | T(1) | None | 0 | 0 | +0.17 | ⊙ |
| 10 | T(2) | KI Solution | 0.4 | 0.4 | +0.30 | x |
| 11 | T(3) | KI Solution | 0.12 | 0.12 | +0.20 | ○ |
| 12 | T(4) | KI Solution | 0.05 | 0.05 | +0.18 | ⊙ |
| 13 | T(5) | AgI Fine grains | 0.4 | 0.4 | +0.33 | x |
| 14* | T(6) | AgI Fine grains | 0.12 | 0.12 | +0.23 | ○ |
| 15* | T(7) | AgI Fine grains | 0.05 | 0.05 | +0.20 | ⊙ |
| 16* | T(8) | $AgNO_3$ + KI Solution | 0.12 | 0.12 | +0.21 | ○ |

*Sample of the present invention

TABLE 2

| Photo-sensitive Material | Emulsion | Iodine: Method of Addition | Iodine: Amount Added (mol %) | Average Iodine Content in Grains (mol %) | Photographic Speed ΔlogE: BPN42 | Photographic Speed ΔlogE: SC52 | Roller Marks |
|---|---|---|---|---|---|---|---|
| 1 | OCT(1) | None | 0 | 0 | Standard | — | ⊙ |
| 17 | OCT(1) | None | 0 | 0 | −0.3 | Standard | ⊙ |
| 18 | OCT(2) | KI Solution | 0.4 | 0.4 | −0.32 | +1.0 | x |
| 19 | OCT(3) | KI Solution | 0.25 | 0.25 | −0.56 | +0.7 | Δ |
| 20 | OCT(4) | KI Solution | 0.1 | 0.1 | −0.85 | +0.45 | ○ |
| 21 | OCT(5) | AgI Fine grains | 0.4 | 0.4 | −0.27 | +1.03 | x |
| 22* | OCT(6) | AgI Fine grains | 0.25 | 0.25 | −0.51 | +0.80 | Δ |
| 23* | OCT(7) | AgI Fine grains | 0.1 | 0.1 | −0.79 | +0.50 | ○ |
| 24* | OCT(8) | $AgNO_3$ + KI Solution | 0.25 | 0.25 | −0.53 | +0.78 | Δ |
| 25 | T(1) | None | 0 | 0 | −0.70 | +0.65 | ⊙ |
| 26 | T(2) | KI Solution | 0.4 | 0.4 | +0.15 | +1.50 | x |
| 27 | T(3) | KI Solution | 0.12 | 0.12 | −0.1 | +1.25 | ○ |
| 28 | T(4) | KI Solution | 0.05 | 0.05 | −0.25 | +1.05 | ⊙ |
| 29 | T(5) | AgI Fine grains | 0.4 | 0.4 | +0.23 | +1.60 | x |
| 30* | T(6) | AgI Fine grains | 0.12 | 0.12 | +0.05 | +1.40 | ○ |
| 31* | T(7) | AgI Fine grains | 0.05 | 0.05 | −0.09 | +1.25 | ⊙ |
| 32* | T(8) | $AgNO_3$ + KI Solution | 0.12 | 0.12 | +0.02 | +1.35 | ○ |

*Sample of the present invention

It is clear from the results shown in Table 1 that the extent roller marks is substantially dependent on the amount of iodine which has been added. On forming octahedral and tabular grains which uniformly contained about 0.4 mol % of iodine by using a mixed solution of potassium bromide and potassium iodide for the halogen solution, when carrying out the controlled double jet additions in a separate experiment and comparing these with OCT-2, OCT-5, T-2 and T-5, it was clear that roller marks were greatly dependent on the amount of iodine at the surface. Hence, it is necessary to reduce the amount of surface iodine in order to provide an improvement in respect of roller marks.

There is an improvement in the extent of roller marks when the amount of iodine added is reduced, but it is clear on comparing the methods by which the iodine of this invention is added that there are differences in photographic speed. Furthermore, the tabular grains of the present invention clearly provided a higher photographic speed than the octahedral grains.

The performances when a sensitizing dye had been added to each emulsion are compared in Table 2. When a sensitizing dye had been added the blue light photographic speed was greatly reduced. The blue light photographic speed recovered when iodine was added and the SC52 speed increased. There was a clear correlation with roller marks and photographic speed in this case and the effectiveness of the invention is clear. Moreover, on comparing the photographic speeds with the SC52 exposure it is clear that a much better effect is obtained with this invention with tabular grains.

EXAMPLE 2

Preparation of Octahedral Emulsions 11–14 for Comparison and of the present Invention Octahedral grains of diameter 0.62 μm were formed in the same way as in Example 1. The method used to form the surface iodine layer and the amount of iodine added was a shown in Table 3. After removing the soluble salts using a sedimentation method, the emulsions were reheated to 40° C., 35 grams of gelatin, 2.35 grams of phenoxyethanol and 0.8 grams of poly(sodium styrenesulfonate) as thickener were added. The pH was adjusted to 6.0 with caustic soda. The pAg value of the emulsions obtained in this way was 8.25.

These emulsions were chemically sensitized while being maintained at 60° C. with stirring. First of all, 350 mg of the sensitizing dye used in Coated Samples 17–32 in Example 1 was added and then 3.3 mg of sodium thiosulfate, 2.6 mg of chloroauric acid and 90 mg of potassium thiocyanate were added and the emulsions were cooled to 35° C. after 40 minutes.

Emulsions OCT-11 to OCT-14 were obtained in this way.

Preparation of Octahedral Emulsions 15–17 for Comparison and of the present Invention Potassium bromide (0.35 grams) and 20.6 grams of gelatin were added to 1 liter of water and 40 cc of an aqueous silver nitrate solution (0.28 gram as silver nitrate) and 40 cc of an aqueous potassium bromide solution (0.21 gram as potassium bromide) were added simultaneously to the solution which was being maintained at 50° C., with stirring, over a period of 10 minutes using the double jet method. Next, 200 cc of aqueous silver nitrate solution (1.42 grams as silver nitrate) and 200 cc of aqueous potassium bromide solution (1.06 grams as potassium bromide) were added simultaneously over a period of 8 minutes, followed by further adding 27 cc of an aqueous potassium bromide solution (2.7 g as potassium bromide). Subsequently, an aqueous potassium nitrate solution and a mixed aqueous solution of potassium bromide and potassium iodide was added using the controlled double jet method. The amount of aqueous silver nitrate solution added was 1 liter (140 grams of silver nitrate), and the flow rate was 2 cc/minute at the start of the addition and this was accelerated linearly in such a way that the addition was completed in 70 minutes. The mixed aqueous solution of potassium bromide and potassium iodide was added simultaneously with control in such a way that the control potential was pAg=8.58.

The mixing ratio of the potassium bromide and potassium iodide at this time was varied and octahedral silver iodobromide emulsions which had different halogen compositions were obtained. The octahedral grains obtained were monodisperse, and the average diameters were about 0.62 μm.

The method of forming the surface iodine layer was the same at that used in Example 1, and the amount added was as shown in Table 3.

After removing the soluble salts using a sedimentation method, the temperature was raised to 40° C. and 35 grams of gelatin, 2.35 grams of phenoxyethanol and 0.8 gram of poly(sodium styrenesulfonate) as thickener were added. The pH was adjusted to 6.0 with caustic soda. The pAg value of the emulsions obtained in this way was 8.25.

These emulsions were chemically sensitized while being maintained at 60° C. with stirring. First of all, 350 mg of the sensitizing dye used in Coated Samples 17–32 in Example 1 was added and then 3.3 mg of sodium thiosulfate, 2.6 mg of chloroauric acid and 90 mg of potassium thiocyanate were added, and the emulsions were cooled to 35° C. after 40 minutes.

Emulsions OCT-15 to OCT-17 were obtained in this way.

Preparation of Coated Samples

The reagents indicated below were added per mol of silver halide to emulsions OCT-11 to OCT-17 and coating liquids were obtained.

| | |
|---|---|
| 2,6-Bis(hydroxyamino)-4-diethylamino-1,3,5-triazine | 72 mg |
| Gelatin | The amount which provided a total coated weight with the gelatin used in the surface protective layer described hereinafter indicated in Table 3 was added |
| Trimethylolpropane | 9 grams |
| Dextran (average molecular weight 39,000) | 18.5 grams |
| Poly(sodium styrenesulfonate) (average molecular weight 600,000) | 1.8 grams |
| Film Hardening Agent | |
| 1,2-Bis(vinylsulfonylacetamido)ethane | Added in an amount to adjust the swelling factor to 225% |
| 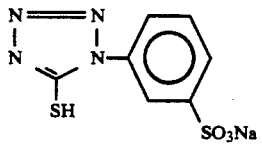 | 34 mg |

Preparation of the Surface Protective Layer Coating Liquid

The surface protective layer was prepared from the components indicated below in the coated weights shown below.

| Content of the Surface Protective Layer | Coated Weight ($g/m^2$) |
|---|---|
| Gelatin | 0.966 |
| Poly(sodium acrylate) (average molecular weight 400,000) | 0.023 |
| 4-Hydroxy-6-methyl-1,3,3a,7-tetra-azaindene | 0.015 |
| 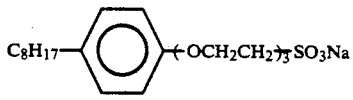 | 0.013 |
| $C_{16}H_{33}O-(CH_2CH_2O)_{10}-H$ | 0.045 |
| $C_{17}H_{33}CON(CH_3)CH_2CH_2SO_3Na$ | 0.0065 |
| $C_8F_{17}SO_2N(C_3H_7)-(CH_2CH_2O)_{15}-H$ | 0.003 |
| $C_8F_{17}SO_2N(C_3H_7)-(CH_2CH_2O)_4-(CH_2)_4SO_3Na$ | 0.001 |
| Poly(methyl methacrylate) (average particle size 3.7 μm) | 0.087 |
| Proxel (Adjusted to pH 6.4 with NaOH) | 0.0005 |

Preparation of Photosensitive Materials

An emulsion layer and a surface protective layer were coated onto both sides of a similar support to that use in Example 1 using a simultaneous extrusion method. The coated silver weight was 1.75 $g/m^2$ per side. Photosensitive Materials 101 to 110 were obtained in this way.

Evaluation of Photographic Performance

Samples of Photosensitive Materials 101 to 110 were exposed from both sides at the same time for 0.1 second using a sharp cut filter SC52 made by the Fuji Photo Film Co., Ltd. and the color sensitized speeds were evaluated. After exposure, processing was carried out in the way indicated below.

| | |
|---|---|
| Automatic Processor: | Modified FPM9000 made by the Fuji Photo Film Co., Ltd. with increased transporting speed. |
| Developer: | RD-7 made by the Fuji Photo Film Co., Ltd. |
| Fixer: | FujiF, made by the Fuji Photo Film Co., Ltd. |
| Processing Speed: | Dry to Dry, 30 seconds |
| Development Temp.: | 37° C. |
| Fixing Temp.: | 33° C. |
| Drying Temp.: | 50° C. |
| Replenishment Rate: | Developer: 22 ml/10 × 12 inch<br>Fixer: 30 ml /10 × 12 inch |

The photographic speed is given as a log representation of the ratio of the exposure which provided a density of 1.0 taking Photosensitive Material 101 as a standard.

Evaluation of Drying Properties

The drying properties were evaluated by touching the film on processing the photosensitive material (10×12 inch) continuously under the same conditions as used for the evaluation of photographic performance.

The films were processed continuously with the short edge in the transporting direction.

⊙—The film was warm and dry even with 30 sheets. There was no problem at all.

○—The film was completely dry even with 30 sheets. The temperature on emergence was of the same order as that of a film which had been standing at room temperature.

Δ—The films were rather cold on processing 30 sheets but there was no sticking together of the continuously processed films and this was a tolerable level in practice.

×—The films were damp on processing 30 sheets and drying was not complete. The films stuck together.

Evaluation of Roller Marks

As in Example 1, the transporting rollers in the development tank and the cross-over rollers between development and fixation were replaced by intentionally fatigued rollers. The other processing conditions were the same as for the evaluation of photographic performance as described earlier.

The results of the evaluation are shown in Table 3.

On comparing Photosensitive Materials 101 to 104 it is clear that Photosensitive Material 104 which had a small amount of added surface iodine and which had been obtained by the addition of fine AgI grains of the present invention exhibited excellent performance in terms of both photographic speed and roller marks.

On comparing photosensitive materials 104 to 107 it is clear that the effect of the present invention is lost when the average iodide content exceeds 1.0 mol %. Furthermore, the effect of the invention is especially pronounced when the average iodine content is not more than 0.5 mol %.

Photosensitive Materials 105 and 108 to 110 were prepared using the same emulsion, OCT-15, and these show the dependence of the effect of the present invention on the coated weight of gelatin. The swelling factor had been adjusted to 225% in each case, but with a coated gelatin weight per side of 2.8 g/m$^2$ there was a worsening of drying properties in ultra-rapid processing with a dry to dry time of 30 seconds and the appeal of the invention was reduced.

As indicated above, the effect of the invention is clear.

EXAMPLE 3

Preparation of Tabular Emulsions 11–14 for Comparison and of The present Invention Mono-disperse tabular grains of which the variation coefficient of the size distribution was 16.5%, average projected area diameter was 1.02 μm and the thickness was 0.180 μm were prepared in the same way as in Example 1. The method of addition and the amount of iodine added in the surface iodine layer are shown in Table 5. After removing the soluble salts using a sedimentation method, the temperature was raised to 40° C., 35 grams of gelatin, 2.35 grams of phenoxyethanol and 0.8 gram of poly(sodium styrenesulfonate) as thickener were added. The pH was adjusted to 6.0 using caustic soda. The pAg value of the emulsions obtained in this way was 8.20.

Chemical sensitization was carried out while maintaining the emulsion at 60° C. with stirring. First of all 500 mg of the sensitizing dye used in Coated Samples 17–32 in Example 1 was added and then 3.3 mg of sodium thiosulfate, 2.6 mg of chloroauric acid and 90 mg of potassium thiocyanate were added, and the emulsions were cooled to 35° C. after 40 minutes.

Emulsions T-11 to T-14 were obtained in this way.

TABLE 3

| Photo-sensitive Material | Emulsion | Surface Iodine: Method of Addition | Surface Iodine: Amount Added (mol %) | Average Iodine Content in Grains (mol %) | Coated Gelatin Weight per Side (g/m$^2$) | Drying Pro-perties | Photographic Speed ΔlogE | Roller Marks |
|---|---|---|---|---|---|---|---|---|
| 101 | OCT11 | — | None | 0.0 | 1.85 | ⊙ | Standard | ⊙ |
| 102 | OCT12 | KI Solution | 0.4 | 0.4 | 1.85 | ⊙ | +0.25 | x |
| 103 | OCT13 | KI Solution | 0.05 | 0.05 | 1.85 | ⊙ | +0.03 | ⊙ |
| 104* | OCT14 | AgI Fine grains | 0.05 | 0.05 | 1.85 | ⊙ | +0.20 | ⊙ |
| 105* | OCT15 | AgI Fine grains | 0.05 | 0.45 | 1.85 | ⊙ | +0.22 | ○ |
| 106* | OCT16 | AgI Fine grains | 0.05 | 0.95 | 1.85 | ⊙ | +0.24 | Δ |
| 107 | OCT17 | AgI Fine grains | 0.05 | 1.95 | 1.85 | ⊙ | +0.21 | x |
| 108* | OCT15 | AgI Fine grains | 0.05 | 0.45 | 2.15 | ○ | +0.21 | ○ |
| 109* | OCT15 | AgI Fine grains | 0.05 | 0.45 | 2.5 | Δ | +0.19 | ○ |
| 110* | OCT15 | AgI Fine grains | 0.05 | 0.45 | 2.8 | x | +0.15 | ○ |

*Sample of the present invention

Preparation of Tabular Emulsions 15–20 for Comparison and of The present Invention Potassium bromide (9.0 grams), 12 grams of gelatin and 2.5 cc of a 5% aqueous solution of the thioether $HO(CH_2)_2S(CH_2)_2S(CH_2)_2OH$ were added to 1 liter of water and 37 cc of an aqueous silver nitrate solution (3.43 grams as silver nitrate) and 33 cc of an aqueous solution which contained 3.22 grams of potassium bromide were added to this solution which was being maintained at 45° C., with stirring, over a period of 37 seconds using the double jet method. Next, the temperature was raised to 70° C. and 90 cc of an aqueous silver nitrate solution (8.33 grams of silver nitrate) was added over a period of 22 minutes. Here, 9 cc of 25% aqueous ammonia was added and the mixture was physically ripened for 15 minutes at the same temperature, after which 8.4 cc of a 100% acetic acid solution was added. Then, an aqueous solution of 129.9 grams of silver nitrate and a mixed aqueous solution of potassium bromide and potassium iodide were added over a period of 35 minutes using the controlled double jet method while maintaining a pAg value of 8.51. The tabular emulsions so obtained were all mono-disperse, but the grain size and distribution varied with the amount of potassium iodide added with the controlled double jet method.

TABLE 4

| Emulsion | Ave. Iodine Content in Grains | Ave. Projected Area Diameter of Grains (μm) | Thickness (μm) | Variation Coefficient of Diameter (%) |
|---|---|---|---|---|
| T-14 | 0.05 | 1.02 | 0.180 | 16.5 |
| T-15 | 0.45 | 1.10 | 0.172 | 18.2 |
| T-16 | 0.95 | 1.15 | 0.168 | 19.5 |
| T-17 | 1.95 | 1.21 | 0.163 | 22 |

The grain sizes of Emulsions T-18 to T-20 were more or less the same as those of Emulsions T-15 to T-17.

Preparation of Coated Samples

The same reagents as added to Emulsions OCT-11 to OCT-17 in Example 2 were added in the same amounts to Emulsions T-11 to T-20.

The surface protective layer and the support were just the same as in Example 2. The coated silver weight per side was 1.75 g/m$^2$, and Photosensitive Materials 201–203 were obtained by coating on both sides of the support.

The photographic performance, drying properties and roller mark performance were then evaluated in the same way as described in Example 2. The results obtained are shown in Table 5.

TABLE 5

| Photosensitive Material | Emulsion | Surface Iodine: Method of Addition | Surface Iodine: Amount Added (mol %) | Average Iodine Content in Grains (mol %) | Coated Gelatin Weight per Side (g/m$^2$) | Drying Properties | Photographic Speed ΔlogE | Roller Marks |
|---|---|---|---|---|---|---|---|---|
| 101 | OCT11 | — | None | 0.0 | 1.85 | ◎ | Standard | ◎ |
| 201 | T11 | — | None | 0.0 | 1.85 | ◎ | +0.15 | ◎ |
| 202 | T12 | KI Solution | 0.4 | 0.4 | 1.85 | ◎ | +0.38 | x |
| 203 | T13 | KI Solution | 0.05 | 0.05 | 1.85 | ◎ | +0.19 | ◎ |
| 204* | T14 | AgI Fine grains | 0.05 | 0.05 | 1.85 | ◎ | +0.35 | ◎ |
| 205* | T15 | AgI Fine grains | 0.05 | 0.45 | 1.85 | ◎ | +0.37 | ○ |
| 206* | T16 | AgI Fine grains | 0.05 | 0.95 | 1.85 | ◎ | +0.40 | Δ |
| 207 | T17 | AgI Fine grains | 0.05 | 1.95 | 1.85 | ◎ | +0.35 | x |
| 208* | T15 | AgI Fine grains | 0.05 | 0.45 | 2.15 | ○ | +0.35 | ○ |
| 209* | T15 | AgI Fine grains | 0.05 | 0.45 | 2.5 | Δ | +0.33 | ○ |
| 210* | T15 | AgI Fine grains | 0.05 | 0.45 | 2.8 | x | +0.29 | ○ |
| 211* | T18 | $AgNO_3$ + KI | 0.05 | 0.45 | 1.85 | ◎ | +0.35 | ○ |
| 212* | T19 | $AgNO_3$ + KI | 0.05 | 0.95 | 1.85 | ◎ | +0.37 | Δ |
| 213 | T20 | $AgNO_3$ + KI | 0.05 | 1.95 | 1.85 | ◎ | +0.32 | x |

*Sample of the present invention

The method of forming the surface iodine layer was as described in Example 1.

The amount added is shown in Table 5.

After removing the soluble salts using a sedimentation method, the temperature was raised to 40° C., 35 grams of gelatin, 2.35 grams of phenoxyethanol and 0.8 gram of poly(sodium styrenesulfonate) as thickener were added. The pH was adjusted to 6.0 using sodium hydroxide. The pAg value of the emulsions obtained in this way was 8.25.

Chemical sensitization was carried out while maintaining the emulsion at 60° C. with stirring. First of all 500 mg of the sensitizing dye used in Coated Samples 17–32 in Example 1 was added and then 3.3 mg of sodium thiosulfate, 2.6 mg of chloroauric acid and 90 mg of potassium thiocyanate were added, and the emulsions were cooled to 35° C. after 40 minutes.

Emulsions T-15 to T-20 were obtained in this way. The results obtained on measuring the grain size of Emulsions T-15 to T-17 were shown in Table 4 below, with the properties of Emulsion T-14 being also indicated.

On comparing Photosensitive Material 101 and Photosensitive Materials 201 to 204 it is clear that Photosensitive Material 204 with which the amount of surface iodine was small and which had been prepared by the addition of fine AgI grains of the present invention was excellent in terms of both photographic speed and roller marks. Furthermore, the tabular grains of this invention exhibited more pronounced effect than the octahedral grains.

On comparing photosensitive materials 204 to 207 it is clear that the effect of the present invention is lost when the average iodide content exceeds 1.0 mol %. Furthermore, the effect of the invention is especially pronounced when the average iodine content is not more than 0.5 mol %.

The same emulsion, T-15, was used in Photosensitive Materials 205 and 208 to 210, and they show that the effect of this invention is dependent on the coated gelatin weight. The swelling factors had all to be adjusted to about 225%, but with a coated gelatin weight per side of about 2.8 g/m$^2$ there was a worsening of drying properties in ultra-rapid processing with a dry to dry time of 30 seconds and the appeal of the invention was reduced.

Photosensitive Materials 211 to 213 show the improving effect due to the simultaneous addition of silver nitrate solution and KI solution of the present invention. It is clear that when the average iodine content exceeds 1.0 mol % the effect of the invention is lost even with the tabular emulsions T-18 to T-20.

As indicated above, the effect of the invention is clear.

EXAMPLE 4

Preparation of Tabular Emulsions T-21 of this Invention

Potassium bromide (4.5 grams), 20.6 grams of gelatin and 2.5 cc of a 5% aqueous solution of the thioether $HO(CH_2)_2S(CH_2)_2S(CH_2)_2OH$ were added to 1 liter of water and 37 cc of an aqueous silver nitrate solution (3.43 grams of silver nitrate) and 33 cc of an aqueous solution which contained 2.97 grams of potassium bromide and 0.363 gram of potassium iodide were added to this solution which was being maintained at 60° C., with stirring, over a period of 37 seconds using the double jet method. Next, after adding 0.9 gram of potassium bromide, the temperature was raised to 70° C. and 53 cc of an aqueous silver nitrate solution (4.90 grams of silver nitrate) was added over a period of 13 minutes. Here, 15 cc of 25% aqueous ammonia was added and the mixture was physically ripened for 20 minutes at the same temperature, after which 14 cc of a 100% acetic acid solution was added. Then, an aqueous solution of 133.3 grams of silver nitrate and an aqueous solution of potassium bromide were added over a period of 35 minutes using the controlled double jet method while maintaining a pAg value of 8.5. Next, 10 cc of a 2N potassium thiocyanate solution and 0.05 mol % with respect to the total amount of silver of the fine AgI grains of Example 1 were added. After physical ripening for 5 minutes at the same temperature, the temperature was reduced to 35° C. Mono-disperse tabular grains of iodine content 0.31 mol %, average projected area diameter 1.10 μm, thickness 0.165 μm and of which the variation coefficient of the diameter was 18.5% were obtained in this way.

Subsequently, the soluble salts were removed using a sedimentation method. The temperature was raised to 40° C., 35 grams of gelatin, 2.35 grams of phenoxyethanol and 0.8 gram of poly(sodium styrenesulfonate) as thickener were added, the pH was adjusted to 5.90 and the pAg was adjusted to 8.25 using caustic soda and silver nitrate solution.

Chemical sensitization was carried out while maintaining the emulsion at 56° C. with stirring. First of all 0.043 mg of thiourea dioxide was added and reduction sensitization was carried by maintaining these conditions for 22 minutes. Next, 20 mg of 4-hydroxy-6-methyl-1,3,3a-7-tetraazaindene and 500 mg of the sensitizing dye used in the coated materials in Example 1 was added. Moreover, 1.1 grams of an aqueous calcium chloride solution was added. Next, 3.3 mg of sodium thiosulfate, 2.6 mg of chloroauric acid and 90 mg of potassium thiocyanate were added, and the emulsions were cooled to 35° C. after 40 minutes.

The preparation of the tabular emulsion T-21 of the present invention was completed in this way.

Preparation of Coated Materials

The reagents indicated below were added per mol of silver halide to Emulsion T-21 and a coating liquid was obtained.

| | |
|---|---|
| 2,6-Bis(hydroxyamino)-4-diethylamino-1,3,5-triazine | 72 mg |
| Gelatin | The amount which provided a total coated weight with the gelatin used in the surface protective layer described hereinafter indicated in Table 6 was added |
| Trimethylolpropane | 9 grams |
| Dextran (average molecular weight 39,000) | 18.5 grams |
| Poly(sodium styrenesulfonate) (average molecular weight 600,000) | 1.8 grams |
| Film Hardening Agent | |
| 1,2-Bis(vinylsulfonylacetamido)ethane | Added in an amount to adjust the swelling factor to the value shown in Table 6 |
| 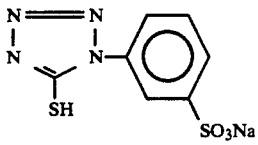 | 34 mg |
| 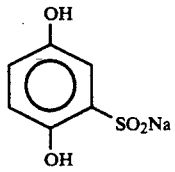 | 10.9 grams |

Preparation of the Surface Protective Layer Coating Liquid

The surface protective layer was prepared from the components indicated below in the coated weights shown below.

| Content of the Surface Protective Layer | Coated Weight ($g/m^2$) |
|---|---|
| Gelatin | 0.966 |
| Poly(sodium acrylate) (average molecular weight 400,000) | 0.023 |
| 4-Hydroxy-6-methyl-1,3,3a,7-tetra-azaindene | 0.015 |
| 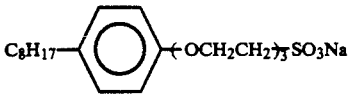 | 0.013 |
| $C_{16}H_{33}O-(CH_2CH_2O)_{10}-H$ | 0.045 |
| $C_{17}H_{33}CON(CH_3)CH_2CH_2SO_3Na$ | 0.0065 |
| $C_8F_{17}SO_2N(C_3H_7)-(CH_2CH_2O)_{15}-H$ | 0.003 |
| $C_8F_{17}SO_2N(C_3H_7)-(CH_2CH_2O)_4-(CH_2)_4SO_3Na$ | 0.001 |

-continued

| Content of the Surface Protective Layer | Coated Weight ($g/m^2$) |
|---|---|
| Poly(methyl methacrylate) (average particle size 3.7 μm) | 0.087 |
| Proxel | 0.0005 |
| (Adjusted to pH 6.4 with NaOH) | |

Preparation of the Support (1) Preparation of the Under-layer Dye D-1

The dye indicated below was ball milled using the method disclosed in JP-A-63-197943.

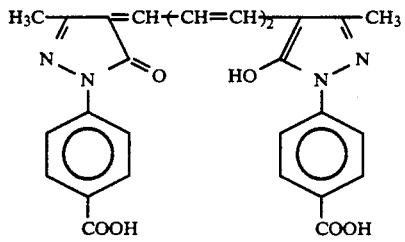

Water (434 ml) and 791 ml of a 6.7% aqueous solution of Triton X-200 ®surfactant (TX-200 ®) were introduced into a 2 liter ball mill. The dye (20 grams) was added to this solution. Zirconium oxide (ZrO) beads (400 ml, 2 mm diameter) were added and the contents of the mill were pulverized for a period of 4 days. After this, 160 grams of 12.5% gelatin was added. After debubbling, the ZrO beads were removed by filtration. On observing the dye dispersion so obtained the particle size of the crushed dye was found to have a wide distribution ranging from 0.05 to 1.15 μm and the average particle size was 0.37 μm.

Moreover, the dye particles of a size greater than 0.9 μm were removed by centrifuging.

The dye dispersion D-1 was obtained in this way.

(2) Preparation of the Support

A biaxially extended poly(ethylene terephthalate) film of thickness 183 μm was subjected to a corona discharge treatment and a first coating liquid of which the composition is indicated below was coated with a wire bar coater to provide a coating of 5.1 $cc/m^2$ and this was dried for 1 minute at 175° C. Next, a first under-layer was established on the opposite side of the support in the same way.

The dye of which the structure is indicated below was included in an amount of 0.04 wt % in the poly(ethylene terephthalate) which was used.

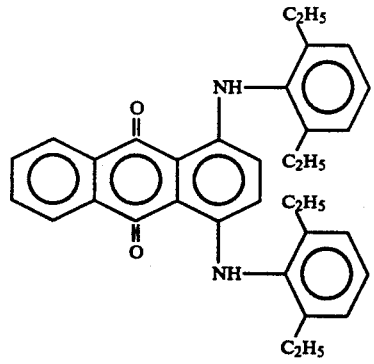

First Coating Liquid

| | |
|---|---|
| Butadiene-styrene copolymer latex solution (solid fraction 40%, butadiene/styrene ratio by weight = 31/69) | 79 cc |
| 2,4-Dichloro-6-hydroxy-s-triazine, sodium salt, 4% solution | 20.5 cc |
| Distilled water | 900.5 cc |
| $nC_6H_{13}OOCCH_2$ / $nC_6H_{13}OOCCH—SO_3Na$ | |

was included in an amount of 0.4 wt % with respect to the latex solid fraction as an emulsification and dispersing agent in the above latex solution.

A second under-layer of which the composition is indicated below was coated onto both sides, one after the other, over the aforementioned first under-layer on both sides of the support using a wire bar coater and dried at a temperature of 150° C.

| Composition for Search Under-layer | |
|---|---|
| Gelatin | 160 $mg/m^2$ |
| Dye dispersion D-1 (26 $mg/m^2$ as dye solid fraction) | |
| 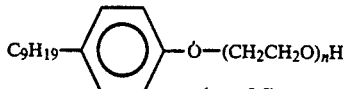 (n = 8.5) | 8 $mg/m^2$ |
| 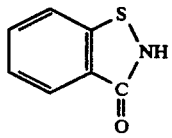 | 0.27 $mg/m^2$ |
| Matting Agent Poly(methyl methacrylate) of average particle size 2.5 μm | 2.5 $mg/m^2$ |

Preparation of Photosensitive Materials

The emulsion layer and the surface protective layer were coated simultaneously onto both sides of the prepared support using an extrusion method. The coated silver weight was 1.75 $g/m^2$ per side. The coated gelatin weight and the swelling factor obtained by the freeze drying method with liquid nitrogen were set as shown in Table 6, adjustments being made with the amounts of gelatin and film hardening agent added to the emulsion layer. The Photosensitive Materials 301 to 306 were obtained in this way.

Evaluation of Photographic Performance

Samples of each of Photosensitive Materials 101 and 301 to 306 were exposed for 0.05 second from both sides using an X-ray ortho-screen HR-4 made by the Fuji Photo Film Co., Ltd. and the photographic speeds were evaluated. After exposure, the processing indicated below was carried out. The photographic speed is shown as a log representation of the ratio of the exposures required to give a density of 1.0 taking Photographic Material 101 as a standard.

| Process I | |
|---|---|
| Automatic Processor: | SRX-501 made by the KONICA company. |
| Developer: | RD-3 made by the Fuji Photo Film Co., Ltd. |
| Fixer: | FujiF, made by the Fuji Photo Film Co., Ltd. |
| Processing Speed: | Dry to Dry, 90 seconds |
| Development Temp.: | 35° C. |
| Fixing Temp.: | 32° C. |
| Drying Temp.: | 45° C. |
| Replenishment Rate: | Developer: 22 ml/10 × 12 inch<br>Fixer: 30 ml /10 × 12 inch |

Process II

Automatic Processor: SRX-501 made by the KONICA company but with modified gearing and motor parts to provide a faster transporting speed.

Development and Fixation

| Developer Concentrate | |
|---|---|
| Potassium hydroxide | 56.6 grams |
| Sodium sulfite | 200 grams |
| Diethylenetriamine penta-acetic acid | 6.7 grams |
| Potassium carbonate | 16.7 grams |
| Boric acid | 10 grams |
| Hydroquinone | 83.3 grams |
| Diethylene glycol | 40 grams |
| 4-Hydroxymethyl-4-methyl-1-phenyl-3-pyrazolidone | 22.0 grams |
| 5-Methylbenzotriazole | 2 grams |
| 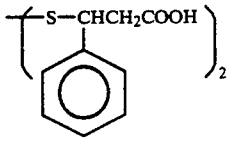 | 0.6 grams |

This was made up to 1 liter with water (pH adjusted to 10.60).

| Fixer Concentrate | |
|---|---|
| Ammonium thiosulfate | 560 grams |
| Sodium sulfite | 60 grams |
| Ethylenediamine penta-acetic acid, di-sodium salt, di-hydrate | 0.10 gram |
| Sodium hydroxide | 24 grams |

This was made up to 1 liter with water (pH adjusted to 5.10 with acetic acid).

The processing liquids were charged in the way indicated below in each tank of the automatic processor at the start of development processing.

Development Tank: The above mentioned developer concentrate (333 ml), 667 ml of water and 10 ml of a starter which contained 2 grams of potassium bromide and 1.8 grams of acetic acid were added and the pH was set to 10.25.

Fixing Tank: The above mentioned fixer concentrate (250 ml) and 750 ml of water.

Processing Speed: Dry to Dry, 30 seconds

Development Temp.: 35° C.

Fixing Temp.: 32° C.

Drying Temp.: 55° C.

Replenishment Rate:

Developer: 22 ml/10×12 inch

Fixer: 30 ml /10×12 inch

Evaluation of Drying Properties

The drying properties of the film were evaluated when using process II. The standards for the evaluation were the same as those used in Example 2.

Evaluation of Fixing Properties

The fixing properties of the film were evaluated when using process II. The evaluation was carried out by comparing the residual silver contents and the residual hypo contents with the JIS standards for the limiting values.

Evaluation of Residual Coloration

The residual coloration of the film was evaluated when using process II. The films processed with process I and process II were compared visually for the standard assessment.

The results obtained are summarized in Table 6.

TABLE 6

| Photo-sensitive Material | Emulison | Coated Gelatin Weight per Side ($g/m^2$) | Swelling Factor (%) | Fixing Properties of Process II | Residual Coloration with Process II | Drying Properties | Photographic Speed Process I | Photographic Speed Process II |
|---|---|---|---|---|---|---|---|---|
| 101 | OCT11 | 1.85 | 225 | No problem | No problem | ◎ | Standard | −0.15 |
| 301 | T21 | 1.85 | 225 | No problem | No problem | ◎ | +0.40 | +0.40 |
| 302 | " | 2.15 | 225 | No problem | No problem | ○ | +0.38 | +0.36 |
| 303 | " | 2.5 | 225 | No problem | No problem | Δ | +0.35 | +0.31 |
| 304 | " | 2.8 | 225 | Lower Permissible Limit | Lower Permissible Limit | x | +0.31 | +0.25 |
| 305 | " | 2.8 | 185 | No good | No good | Δ | +0.26 | +0.15 |
| 306 | " | 2.8 | 140 | No good | No good | ○ | +0.20 | +0.05 |

It is clear from the results shown in Table 6 that Photosensitive Material 301 in which Emulsion T-21 of the present invention had been used was excellent in terms of fixing properties, residual coloration, drying properties and photographic performance, and exhibited especially good performance. Furthermore, the results of the evaluations have been omitted, but Photosensitive Materials 301 to 306 were all free of problems in respect of roller mark performance.

On comparing Photosensitive Materials 301 to 304, it is clear that when the swelling factor is set at about 225%, various aspects of performance such as the fixing properties, residual coloration and drying properties fall to the lower permissible limit for practical use when the coated gelatin weight per side reaches about 2.8 $g/m^2$.

On the other hand, Photosensitive Materials 305 and 306 confirm the effect of adding enough film hardening agent to reduce the swelling factor to 200% or less as disclosed in JP-A-58-111933. As disclosed in the said specification, a high covering power is certainly maintained with Photosensitive Materials 305 and 306, and there is also an improvement in drying properties as the film hardness is increased. However, the fixing properties and residual coloration are worsened when the swelling factor is reduced and the level is not suitable for practical use. Moreover, the fall in photographic performance is severe as the swelling factor is reduced and there is a marked lowering of performance in the case of ultra-rapid processing with process II in particular.

While the invention has been described in detail and with reference to specific embodiments thereof, it will be apparent to one skilled in the art that various changes and modifications can be made therein without departing from the spirit and scope thereof.

What is claimed is:

1. A method for producing a silver halide photographic emulsion comprising silver iodobromide or iodobromochloride grains having an average iodine content of less than 1.0 mol %, wherein each grain comprises a basic grain and a surface portion, which comprises the following step (a) or (b) to form said surface portion of the grains such that said step (a) or said step (b) provides the surface portion having an iodine content of 0.005 mol % to less than 0.3 mol % based on the total amount of silver of said grains:

(a) adding simultaneously a silver nitrate solution and a solution which contains iodine ion; or (b) adding fine particles of AgI and/or fine particles of AgBrI.

2. The method as in claim 1, wherein said average iodine content is less than 0.5 mol %.

3. The method as in claim 1, wherein said step (a) or said step (b) provides the surface portion having an iodine content of 0.01 mol % to less than 0.2 mol % based on the total amount of silver in said grains.

4. The method as in claim 1, wherein said step (a) or said step (b) provides the surface portion having an iodine content of 0.02 mol % to less than 0.1 mol % based on the total amount of silver in said grains.

5. The method as in claim 1, wherein at least 70% of the total projected area of said grains comprises tabular grains having an aspect ratio of at least 3.

6. The method as in claim 1, wherein the average iodine content of said surface portion of the grains is at least 0.1 mol % but less than 20 mol %.

7. The method as in claim 1, wherein the average iodine content of said surface portion of the grains is at least 0.5 mol % but less than 10 mol %.

8. The method as in claim 1, wherein the average iodine content of said surface portion is at least twice the iodine content of a layer of the basic grain which is adjacent to the inside of said surface portion.

9. The method as in claim 1, wherein the average iodine content of said surface portion is at least five times the iodine content of a layer of the basic grain which is adjacent to the inside of said surface portion.

10. The method as in claim 1, wherein said fine particle of AgI and said fine particle of AgBrI have a particle size of not more than 0.5 μm.

11. The method as in claim 1, wherein said step is carried out in the presence of a silver halide solvent.

12. The method as in claim 11, wherein said silver halide solvent is a thioether compound or a thiocyanate.

13. A silver halide photosensitive material comprising a support having thereon at least one hydrophilic colloid layer, wherein said layer is composed of the silver halide photographic emulsion produced by the method of claim 3.

14. The silver halide photosensitive material as in claim 13, wherein said hydrophilic colloid layer or layers are coated in the total amount as gelatin of 1.8 to 2.8 $g/m^2$ per side of the support.

15. The silver halide photosensitive material as in claim 14, wherein said hydrophilic colloid layer or layers provided on the support as a whole have a swelling factor of 200 to 270%.

16. The silver halide photosensitive material as in claim 13, wherein said hydrophilic colloid layer or layers provided on the support as a whole have a swelling factor of 200 to 270%.

* * * * *